US007125313B2

(12) United States Patent
Zelenski et al.

(10) Patent No.: US 7,125,313 B2
(45) Date of Patent: Oct. 24, 2006

(54) APPARATUS AND METHOD FOR ABRADING A WORKPIECE

(75) Inventors: Aleksander Zelenski, Glenview, IL (US); Sergey Cheprasov, Glenview, IL (US)

(73) Assignee: Novellus Systems, Inc., San Jose, CA (US)

( * ) Notice: Subject to any disclaimer, the term of this patent is extended or adjusted under 35 U.S.C. 154(b) by 276 days.

(21) Appl. No.: 10/787,713

(22) Filed: Feb. 25, 2004

(65) Prior Publication Data

US 2004/0166769 A1 Aug. 26, 2004

Related U.S. Application Data

(60) Provisional application No. 60/450,242, filed on Feb. 25, 2003.

(51) Int. Cl.
*B24B 51/00* (2006.01)
*B24B 7/00* (2006.01)

(52) U.S. Cl. ..... 451/5; 451/8; 451/11; 451/262

(58) Field of Classification Search ..... 451/21, 451/63, 262, 5, 8, 11
See application file for complete search history.

(56) References Cited

U.S. PATENT DOCUMENTS 2,751,722 A * 6/1956 Skillings ..... 451/17
2,861,400 A * 11/1958 Ellis ..... 451/1
3,768,212 A * 10/1973 MacKay ..... 451/197
4,315,383 A 2/1982 Day
4,860,498 A 8/1989 Gosis
4,974,370 A 12/1990 Gosis
5,099,614 A 3/1992 Arai et al.
5,181,346 A 1/1993 Paliwoda et al.
5,441,444 A 8/1995 Nakajima
5,595,529 A 1/1997 Cesna et al.
5,779,525 A 7/1998 Boller
5,989,108 A * 11/1999 Ikeda et al. ..... 451/268

FOREIGN PATENT DOCUMENTS

EP 0 481 935 A2 4/1992
EP 0 481 936 A2 4/1992

* cited by examiner

*Primary Examiner*—M. Rachuba
(74) *Attorney, Agent, or Firm*—Ingrassia Fisher & Lorenz, P.C.

(57) ABSTRACT

An apparatus for abrading a workpiece comprises a first plate assembly having a first surface for supporting a workpiece and a second plate assembly having a second surface for engaging the workpiece to abrade a portion thereof. A displacement shaft is mounted for movement with respect to the upper and lower plate assemblies and has a first end configured to engage the upper plate assembly. A feedback assembly is coupled to the displacement shaft for moving the displacement shaft to substantially maintain a predetermined load exerted on the displacement shaft by the upper plate assembly.

28 Claims, 2 Drawing Sheets

APPARATUS AND METHOD FOR ABRADING A WORKPIECE

CROSS-REFERENCES TO RELATED APPLICATIONS

This application claims the benefit of U.S. Provisional Application No. 60/450,242, filed Feb. 25, 2003.

FIELD OF THE INVENTION

This invention relates generally to a method and apparatus for abrading the workpiece, and more particularly, to the abrading or grinding of workpieces using an abrading apparatus that provides automatic thickness control (ATC) through the use of a stepper motor and pressure sensor.

BACKGROUND OF THE INVENTION

Precision abrading machines are well known and are often utilized to abrade one or more surfaces of a workpiece to achieve a desired dimension. This is generally accomplished by using a process known as lapping which removes small, controlled amounts of material from the workpiece surface. One variety of abrading machine employs a fixed bridge. The bridge supports an upper lapping plate that is configured for rotation and vertical movement between a lower abrading position and an upper loading and unloading position. In the loading and unloading position, the workpiece can be loaded into the machine for subsequent lapping and thereafter unloaded when the desired dimension has been achieved. The distance between the loading and unloading positions, requiring the use of a relatively long shaft. This can result in a loss of rigidity and control during the abrading cycle, which in turn may result in reduced accuracy. In addition, machines of this type oftentimes utilize only a single cylinder to apply pressure from above during the abrading cycle. In some cases, however, the single cylinder configurations do not apply sufficient pressure for certain abrading processes.

In another variety of abrading machines, the lower lapping plate extends upward to meet a descending upper plate. That is, both the upper and lower plates move towards each other. Such arrangements, however, may have a problem associated with sealing gaskets and the creation of unwanted budding effects in the system during the lapping cycle.

Still other types of abrading machines utilize a sliding spindle and do not require the use of a long shaft. Such machines, however, are typically mounted on a single column. In one such known device, the upper plate is associated with an arm which is supported for vertical movement by a single column. The entire arm moves downward to position the upper plate. While effective for precision abrading, the apparatus is subject to an undesired cantilever effect during the abrading cycle. That is, when pressure is exerted during the lapping cycle, the arm and the column tend to act as a cantilever which results in loss of rigidity and control. This in turn may result in reduced accuracy. This problem, however, is substantially overcome through use of more recently developed dual column abrading machines.

One known abrading apparatus having a fixed lower plate utilizes a load cell or pressure sensor to detect the pressure applied to the workpieces by an upper rotatable and vertically movable plate. A displacement sensor detects the displacement of the rotating upper plate in a vertical direction as the vertical dimension of the workpiece or workpieces is reduced. The displacement sensor includes a probe which contacts a measurement surface on the upper plate assembly and forwards displacement measurements to a controller. This vertical displacement sensor is mounted on the base of the abrading apparatus and typically contacts a flat pad to provide a reference measurement. This reference measurement is then utilized as an input to a control system which calculates the current position of the upper plate to control the abrading process and determine when the desired workpiece dimension has been achieved. The abrading process is then terminated. This arrangement, however, suffers certain shortcomings. Since physical contact is made between the probe and the upper plate, the rotating upper plate may cause the displacement sensor to bounce or vibrate thereby negatively impacting the precision of the thickness measurements. Furthermore, the contact surface at which the measurement is taken may wear with time and use thus also negatively impacting precision. Additionally, since the electromagnetic displacement sensor measures the absolute distance to a reference surface and not the true thickness of the parts being machined, any increases or decreases in pressure may cause inaccuracies in the control system. Finally, any lateral shifting of the sensor with respect to the reference pad may introduce significant error into the measurement process.

BRIEF SUMMARY OF THE INVENTION

According to an aspect of the invention there is provided an apparatus for abrading a workpiece that comprises a first plate assembly having a first surface for supporting the workpiece and a second plate assembly having a second surface for engaging the workpiece to abrade a portion thereof. A displacement shaft is mounted for movement with respect to the first and second plate assemblies and has a first end configured to engage the second plate assembly. A feedback arrangement is provided and coupled to a second end of the displacement shaft for moving the displacement shaft to substantially maintain a predetermined load exerted on the displacement shaft by the second plate assembly.

According to further aspect of the invention there is provided an apparatus for abrading a workpiece comprising a frame, a carriage slidably mounted to the frame, and a drive mechanism coupled to the carriage for moving the carriage substantially vertically. A lower plate assembly has an upper working surface for supporting the workpiece and an upper abrading plate assembly having a lower working surface for abradingly engaging the workpiece. A displacement shaft having upper and lower ends is slidingly mounted for vertical movement with respect to the upper and lower plate assemblies, the upper end of the displacement shaft being configured to engage the upper plate assembly. A feedback assembly is coupled to the lower end of the displacement shaft for sensing the load between the upper plate assembly and the displacement shaft and, in response thereto, moving the displacement shaft to substantially maintain the predetermined load. A displacement measuring assembly is coupled to the feedback assembly for measuring the movement of the displacement shaft.

According to a still further aspect of the invention there is provided a method for abrading a workpiece to a desired thickness using an abrading apparatus of the type having a vertically stationary lower plate assembly and a vertically moveable and rotatable upper abrading plate assembly. The method comprises measuring a first position of a displacement shaft that is in contact with the upper abrading plate assembly when the upper abrading plate assembly is also in contact with the lower plate assembly and a substantially predetermined load exists between the displacement shaft and the upper abrading plate assembly. A workpiece is then placed between the upper abrading plate assembly and the lower plate assembly, and as the workpiece is abraded, increases in load on the displacement shaft are sensed. The displacement shaft is lowered in response to increases in pressure to maintain the predetermined load, and the abrading process is terminated when the displacement shaft has been sufficiently lowered to achieve the desired thickness.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
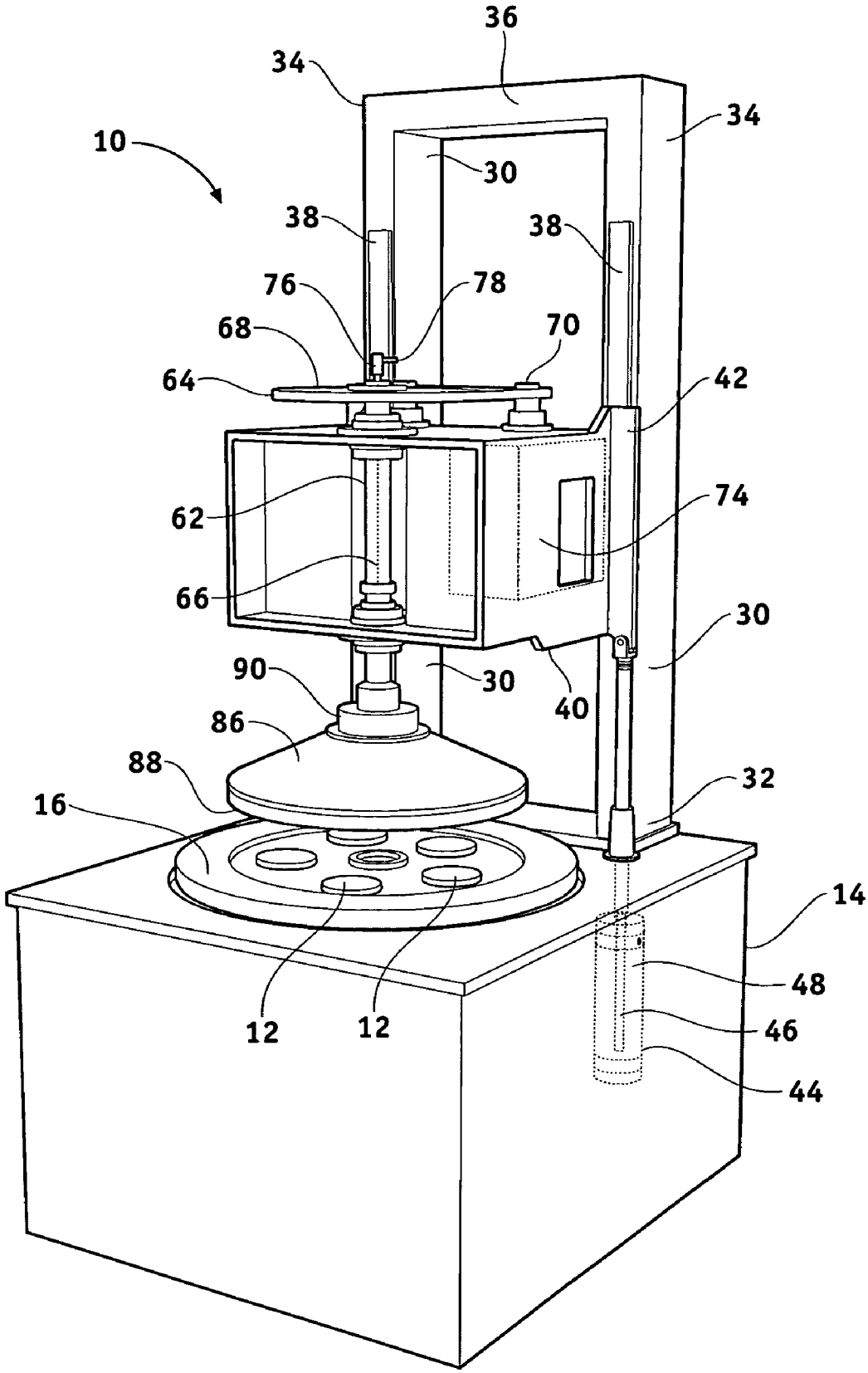
FIG. 1 is an isometric view of an apparatus for abrading a workpiece in accordance with the present invention.
Figure 2:
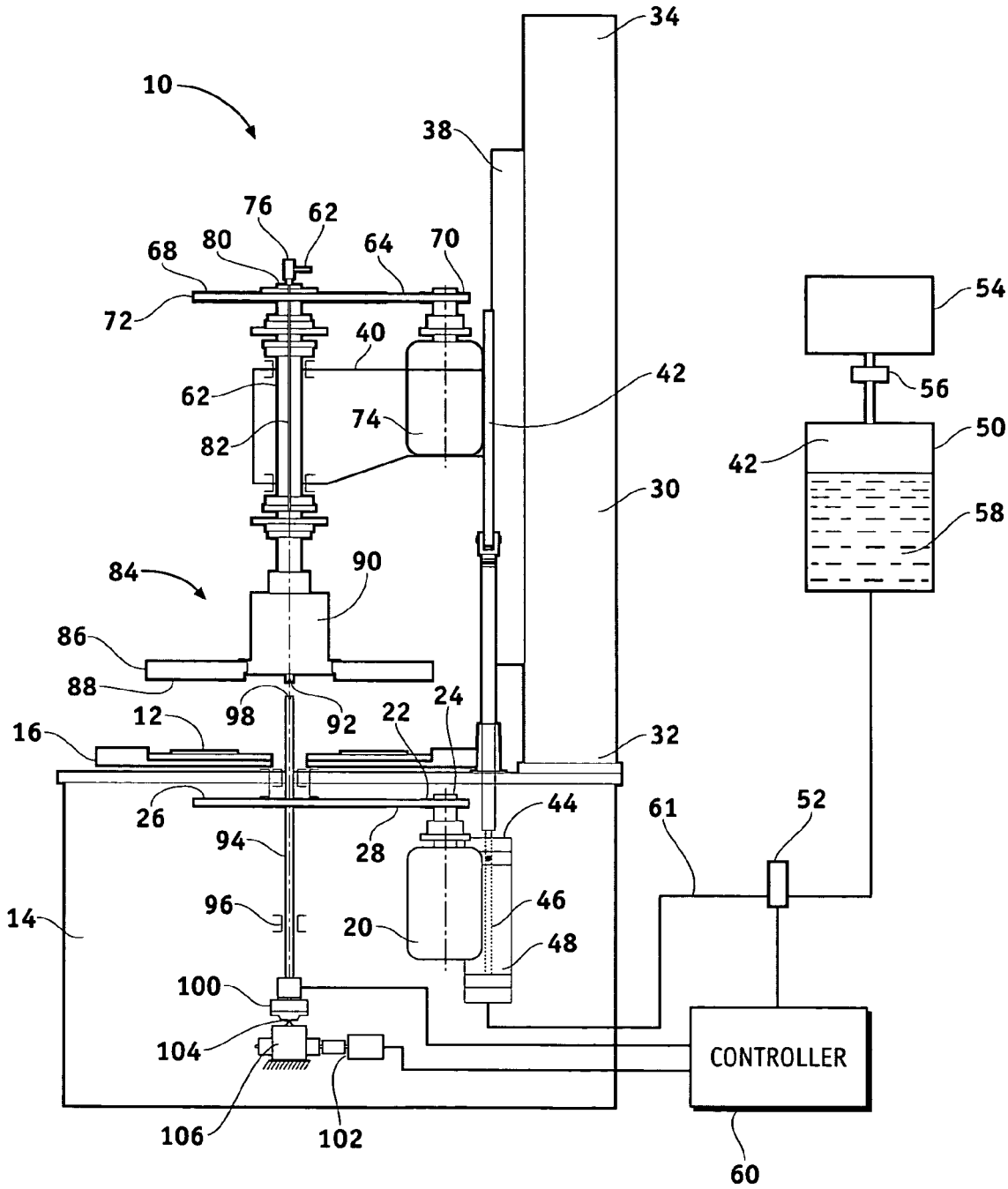
FIG. 2 is a diagrammatic view of the apparatus shown in FIG. 1 illustrating the inventive automatic thickness control system.

FIG. 1 is an isometric view of an abrading apparatus in accordance with the first embodiment of the present invention. Apparatus 10 is capable of abrading any suitable workpiece 12 which may be made of metal, ceramic, semiconductor material (e.g. silicon), or any other abradable material. As used herein, the term "abrading" is intended to include grinding, polishing, planarizing, finishing, and/or lapping and the like. In accordance with one explempary embodiment of the present invention, abrading apparatus 10 comprises a base 14 including a lower abrading wheel 16. Lower abrading wheel 16 is coupled to a motor 20 (FIG. 2) which serves to move lower abrading wheel 16 in a rotational, linear, orbital, or oscillatory manner and any combination thereof. As can be seen in FIG. 2, motor 20 is coupled to lower abrading wheel 16 by means of a pulley 22 coupled to motor shaft 24, pulley 26 coupled to abrading lower abrading wheel 16, and pulley belt 28. Of course, any coupling assembly capable of transferring motion from motor 20 to lower abrading wheel 16 may be employed.

Two support members 30 are fixedly attached at a first and 32 thereof to base 14 and extend substantially vertically from base 14. Support members 30 may be attached to base 14 by any suitable fastening device or method; for example screws, bolts, adhesive, welding, and the like. The two support members 30 may be coupled at second ends 34 by a cross member or brace 36 (FIG. 2) to reduce or substantially eliminate the tendency for support members 30 to rotate about their ends 32. Support members 30 may be formed of any suitable rigid material and structure, such as, for example, round or square metal pipes or tubes. A track member 38 is vertically disposed and is attached to each of support members 30.

Apparatus 10 further comprises a carriage member 40 that includes two flanges 42. A plurality of slide bearings (not shown) for coupling carriage member 40 to track members 38 permit carriage 40 to slide vertically upward and downward along track members 38. At least one vertical drive device 44 is mounted to carriage member 40 so as to move carriage member 40 vertically along track members 38. In a preferred embodiment of the invention, apparatus 10 comprises two vertical drive devices, each disposed proximate to one of the support members 30. It should be appreciated, however, that any suitable number of vertical drive devices 44 may be connected to carriage member 40 and configured to move the carriage member vertically. The vertical drive devices 44 may be fixed at their lower ends to suitable structure of apparatus 10, such as, for example, base 14 for support. Vertical drive devices 44 may comprise any suitable device for raising and lowering carriage member 40. Examples of such devices include pneumatic and hydraulic pistons and shaft assemblies.

As can be seen in FIG. 2, vertical drive devices 44 may comprise well known air/oil cylinders that facilitate the smooth vertical motion of carriage member 26. Examples of air/oil cylinders suitable for use in apparatus 10 include air/oil cylinders manufactured by TRD Manufacturing, Inc. of Loves Park, Ill. In one exemplary embodiment of the invention, the air/oil cylinders each may comprise at their upper ends a piston 46 slidably disposed within a cylinder 48, which may be connected to an air/oil tank 50. To raise piston 46, and thus carriage 26 to which piston 46 is coupled, a gas 42, such as air, may be pumped in air/oil tank 50, which in turn forces hydraulic oil 58 in oil tank 50 though a conduit 61 and an open solenoid on/off valve 52 into cylinder 48 under piston 46. As the oil level in cylinder 48 rises, piston 46 is moved vertically upward through cylinder 48. The solenoid valve 52 then may be closed to prevent back flow of the oil. To lower piston 46, and thus carriage 40, the solenoid valve 52 may be opened and the gas 42 in air/oil tank 50 may be released, causing the oil in cylinder 48 to flow back through conduit 42 into air/oil tank 50. As the oil level in cylinder 48 falls, piston 46 is moved vertically downward within cylinder 48.

A spindle 62 is mounted to and is housed at least partially within carriage member 40. Spindle 62 is coupled at a first end thereof to a rotary drive mechanism 64 that is configured to rotate spindle 62 about a longitudinal axis 66. Rotary mechanism 64 may comprise any suitable device and/or system that is configured to rotate spindle 62 about longitudinal axis 66. In one embodiment, spindle 62 may be attached to a first pulley 68 that is coupled to a second pulley 70 via pulley belt 72. Pulley 70 is connected to motor 74, which, when operating, rotates second pulley 70 about its central axis. As second pulley 70 rotates, it drives belt 72, which in turn rotates first pulley 72 about its central axis. As first pulley 72 rotates, it causes spindle 42 to rotate about its longitudinal axis 66. While a rotary drive mechanism 64 is illustrated and utilizes a belt and pulley mechanism, it should be understood that rotary drive mechanism 64 may comprise any other suitable mechanism for rotating spindle 62. For example, in an alternative embodiment of the present invention, rotary drive mechanism 64 may comprise a gear assembly formed of mutually engaged gears that rotate spindle 62 upon activation of motor 74.

Spindle 62 is also attached at its first end to a rotary lead-through 76 that is configured such that spindle 62 may rotate relative to rotary lead-through 76 during operation of abrading apparatus 10. Rotary lead-through 76 comprises a conduit disposed therein and connected at one end thereof to a supply tube 78 that is in turn coupled to a source of fluid (not shown), such as a gas or liquid. The other end of the conduit is disposed proximate a first opening 80 (FIG. 2) of a longitudinal channel 82 that is disposed within spindle 62 and parallel to its longitudinal axis 66.

Referring to FIG. 2, spindle 62 is mounted at a second end thereof to an upper abrading wheel assembly 84. Upper abrading wheel assembly 84 comprises an upper abrading wheel 86 having a working surface 88. Upper abrading wheel assembly 84 also comprises a rotary coupler 90 that is configured to rotate upper abrading wheel 86 when spindle 62 is rotated about its longitudinal axis 66. A target 92 (e.g. a flat pad or swivel head) is coupled to the underside of upper plate assembly 84 at its center.

A displacement shaft 94 is slidably coupled via bushings 96 (e.g. brass) for vertical movement through lower plate 16. A pad 98 is attached to the upper end of shaft 94 and is adapted for operational coupling to target 92. Positioned at the lower end of shaft 94 is a pressure sensor 100. When upper plate assembly 84 is lowered so as to place target 92 in contact with pad 98 on shaft 94, the load between shaft 94 by upper plate assembly 84 is sensed by pressure sensor 100 and a signal representing this pressure is transmitted from pressure sensor 100 to controller 60. Pressure sensor 100 may comprise a precision thin load-cell of the type made available by Sensotek, Inc., and bearing model numbers 41 and 43.

Shaft 94 is coupled to a stepper motor 102 via pressure sensor 100, jack screw 104, and gear box 106. Rotary motion of a shaft of stepper motor 102 about a horizontal axis is converted by gear box 106 to rotary motion of jack screw 104 about a vertical axis corresponding substantially to the vertical longitudinal axis of shaft 94. Thus, stepper motor 102 is capable of raising or lowering shaft 94 via gear box 106 and jack screw 104. That is, worm gear jack screws can be utilized as translators or rotators. A translating jack has a lifting shaft that moves through a gear box. A nut is integrated with a worm gear such that the worm gear and nut rotate together. When the lift shaft is held to prevent rotation, the lift shaft will move linearly through the gear box to move the load. A rotating jack has a lift shaft that turns moving nut. The lift shaft is fixed to the worm gear causing the load, which is attached to the travel nut, to move along the lift shaft. The number of turns of the worm gear required to move the load one inch is a function of the worm gear ratio and the lead of the screw. For a given screw jack, the number of turns of the worm gear to raise a load (in this case shaft 94) is specified. The motor speed divided by this number is the linear speed of the jack lift shaft or travel nut. Conversely, the desired travel rate multiplied by the number of turns necessary to raise the load one inch equals the input rpm required.

As can be seen, both pressure sensor 100 and stepper motor assembly 102 are coupled to controller 60 which may comprise a programmable logic controller (PLC). In this manner, controller 60 monitors (1) the load being exerted on displacement shaft 96 by upper plate assembly 84 and (2) the position of the upper portion of shaft 94 (i.e. pad 98). Stepper motors and jack screws of the types described above are well known and commercially available from, for example, Nook Industries, Inc., Cleveland, Ohio.

The operation of the abrading apparatus shown in FIG. 2 may best be described in terms of a first or initialization stage and second or operational stage. During the initialization stage, upper plate assembly 84 is lowered via carriage 74 as above described until the lower surface 88 of upper plate 86 rests on the upper surface of lower plate 16. Obviously, at this point workpieces 12 have not yet been placed on lower plate 16. With upper plate 86 resting on lower plate 16 (a load of, for example, 250 kilograms), controller 60 activates stepper motor 102 to raise shaft 94 until pad 98 abuts against target 92 thus increasing the load on shaft 94. When this load reaches a predetermined pressure (e.g. 50 kilograms) as sensed by pressure sensor 100 and monitored by controller 60, vertical movement of shaft 94 is halted. Since stepper motor assembly 102 is coupled to controller 60, controller 60 has monitored the number of stepper motor revolutions necessary to move shaft 94 into engagement with upper plate 86 and achieve a load of 50 kilograms. This represents the zero-point of the ATC system. The number of revolutions is translated into a linear distance position by controller 60 as described above. After the initialization process, upper plate assembly 84 is raised, and workpieces 12 are placed on lower plate 16. Controller 60 is also informed of the target thickness of workpieces 12 via an operator control panel (not shown) and moves the shaft up to a desired position. The number of revolutions of the stepper motor shaft is translated to a linear distance position by controller 60 as described above.

During the operational stage, upper plate 86 is lowered into engagement with workpieces 12. Utilizing the feedback provided by pressure sensor 100 and stepper motor 102, controller 60 continually adjusts the vertical displacement of shaft 94 such that the load on pad 98 remains substantially at 50 kilograms as upper plate 86 lowers due to the thinning of the workpieces. Also, as described above, by monitoring the operation of stepper motor 102, controller 60 determines the distance between pad 98 and the base position of pad 98 measured during the initialization stage.

During the lapping/grinding process, upper plate 86 engages workpieces 12 as described above and is rotated by motor 74. At this point, lower plate 16 may also be rotating by motor 20. The position of shaft 94 is continually adjusted by stepper motor assembly 102 to maintain the predetermined load on shaft 94 (e.g. 50 kilograms). Therefore, as the grinding operation proceeds, the thickness of workpieces 12 decreases causing a lowering of upper plate 86. This, in turn, increases the load exerted by upper plate assembly 84 on shaft 94 which is sensed by pressure sensor 100 and monitored by controller 60. In response, controller 60 activates stepper motor 102 to lower shaft 94 until the load on shaft 94 is again approximately 50 kilograms; i.e. the load exerted on shaft 94 during the initialization process. By monitoring the number of revolutions of step motor 102 as shaft 94 is lowered, controller 60 determines when the distance between the initialization measurement and the current position of pad 98 equals the target thickness of the workpieces 12. At this point, lapping is halted, and the workpieces are removed.

Thus, there has been provided, an automatic thickness control system which utilizes load pressure and the vertical displacement of a shaft 94 with respect to a reference surface. This is accomplished through the use of pressure sensor 100 and stepper motor 102 in cooperation with controller 60 to measure the vertical distance from the tool to reference pad 98. Shaft vertical displacement and pressure measurements are thus accomplished in a simple manner, and complicated circuitry such as linear velocity displacement transducers is unnecessary. Micro-positioning stepper motor 102 and gear box 106 enables stable and rapid positioning of control shaft 94. Controller 60 communicates with pressure sensor 100 and stepper motor 102 to provide real time adjustment of shaft 94 with respect to the reference surface thus allowing real time thickness measurements.

The above described automatic thickness control system measures true distances unaffected by changes due to environmental conditions and load fluctuation. Shaft 94 is placed in physical contact with a reference surface during initialization and remains in contact with the same reference surface during operation. Therefore, the accuracy of the measurement is enhanced and not subject to worn down contact surfaces.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in the exemplary embodiment without departing from the scope of the invention as set forth in the appended claims.

What is claimed is:

1. An apparatus for abrading a workpiece, the apparatus comprising:

a first plate assembly having a first surface far supporting a workpiece;

a second plate assembly having a second surface for engaging the workpiece to abrade a portion thereof;

a displacement shalt mounted for movement with respect to said second plate assembly and said first plate assembly and having a first end configured to engage said second plate assembly; and a feedback assembly coupled to a second end of said displacement shaft, said feedback assembly comprising a pressure sensor configured to sense the load applied to said displacement shaft by said second plate assembly, said feedback assembly configured to move said displacement shaft to substantially maintain a predetermined load exerted on said displacement shaft by said second plate assembly.

2. An apparatus according to claim 1 further comprising a displacement measuring assembly coupled to said feedback assembly for measuring the movement of said displacement shalt with respect to said first plate assembly.

3. An apparatus according to claim 2 further comprising a controller coupled to said feedback assembly and to said displacement measuring assembly for monitoring the thickness of the workpiece.

4. An apparatus according to claim 3 wherein said controller stores a representation of the position of said first surface and receives from the said displacement measuring assembly a representation of the current position of said second surface to determine the thickness of the workpiece.

5. An apparatus according to claim 4 wherein said feedback assembly comprises a drive mechanism coupled to said displacement shaft and responsive to said controller for moving said displacement shaft when said controller determines that the current load being exerted on said displacement shaft by said second plate assembly is substantially different from said predetermined load.

6. An apparatus according to claim 5 wherein said drive mechanism is a first motor having a motor shaft capable of rotation.

7. An apparatus according to claim 6 wherein said motor is a stepper motor.

8. An apparatus according to claim 7 further comprising a threaded shaft coupled to said displacement shaft and to said stepper motor.

9. An apparatus according to claim 8 further comprising a gear assembly coupled to said stepper motor and to said threaded shaft for converting rotary motion of said motor shaft to translational movement of said displacement shaft.

10. An apparatus according to claim 9 wherein said threaded shaft is a jack screw.

11. An apparatus according to claim 10 wherein each rotation of said motor shaft corresponds to a predetermined amount of translational movement of said displacement shaft.

12. An apparatus according to claim 11 wherein said displacement shaft extends Through a central portion of said first plate assembly to engage said second plate assembly.

13. An apparatus according to claim 12 further comprising a target centrally mounted on said second surface.

14. An apparatus according to claim 13 further comprising a pad on the first end of said displacement shaft for engaging said target.

15. An apparatus according to claim 14 wherein said first plate assembly is a lower plate assembly, said second plate assembly is an upper plate assembly, and said displacement shaft is configured for vertical movement.

16. An apparatus according to claim 15 wherein said upper plate assembly is configured for rotational and vertical movement with respect to said lower plate assembly.

17. An apparatus for abrading a workpiece, the apparatus comprising:

a frame;

a carriage slidably mounted an said frame;

a drive mechanism coupled to said carriage for moving said carriage substantially vertically;

a lower plate assembly having an upper working surface for supporting the workpiece;

an upper abrading plate assembly having a lower working surface for abradingly engaging the workpiece;

a displacement shaft having upper and lower ends and slidingly mounted for vertical movement with respect to said upper plate assembly and said lower plate assembly, said upper end configured to engage said upper plate assembly;

a feedback assembly comprising a pressure sensor coupled to the lower end of said displacement shaft for sensing the load applied to said displacement shaft by said upper plate assembly, said feedback assembly configured to move said displacement shaft to substantially maintain a predetermined load; and a displacement measuring assembly coupled to said feedback assembly for measuring the movement of said displacement shaft.

18. An apparatus according to claim 17 wherein said displacement measuring assembly measures the movement of said displacement shaft with respect to said lower plate assembly.

19. An apparatus according to claim 18 further comprising a controller coupled to said feedback assembly and to said displacement measuring assembly wherein said controller stores a representation of the position of said upper working surface and receives from said displacement measuring assembly a representation of the current position of said lower working surface to determine the thickness of the workpiece.

20. An apparatus according to claim 19 wherein said feedback assembly comprises a drive motor coupled to said displacement shaft and responsive to said controller for moving said displacement shaft when said controller determines that the current load being exerted on said displacement shaft by said upper plate assembly is substantially different from said predetermined load.

21. An apparatus according to claim 20 wherein said motor is a stepper motor.

22. An apparatus according to claim 21 further comprising:

a threaded shall coupled to said displacement shaft and to said stepper motor; and a gear assembly coupled to said stepper motor and to said threaded shaft for converting rotary motion of said motor shaft to translational movement of said displacement shall.

23. An apparatus according to claim 22 wherein said threaded shaft is a jack screw.

24. An apparatus according to claim 23 wherein each rotation of said motor shaft corresponds to a predetermined about of translational movement of said displacement shaft.

25. An apparatus according to claim 24 wherein said displacement shaft extends through a central portion of said lower plate assembly to engage said upper abrading plate assembly.

26. An apparatus according to claim 25 further comprising a target centrally mounted on said lower working surface.

27. An apparatus according to claim 26 further comprising a pad on the first end of said displacement shaft for engaging said target.

28. An apparatus according to claim 27 wherein said upper abrading plate assembly is configured for rotation and vertical movement with respect to said lower plate assembly.

* * * * *

UNITED STATES PATENT AND TRADEMARK OFFICE

CERTIFICATE OF CORRECTION

PATENT NO. : 7,125,313 B2
APPLICATION NO. : 10/787713
DATED : October 24, 2006
INVENTOR(S) : Zelenski et al.

It is certified that error appears in the above-identified patent and that said Letters Patent is hereby corrected as shown below:

In Column 7, Line 25, delete “shalt” and add --shaft--;
In Column 7, Line 40, delete “shalt” and add --shaft--;
In Column 8, Line 10, delete “Through” and add --through--;
In Column 8, Line 27, delete “an” and add --on--;
In Column 9, Line 5, delete “shall” and add --shaft--; and
In Column 9, Line 10, delete, “shall” and add --shaft--.

Signed and Sealed this

Ninth Day of January, 2007

JON W. DUDAS
*Director of the United States Patent and Trademark Office*